US009925585B2

(12) United States Patent
Lin

(10) Patent No.: US 9,925,585 B2
(45) Date of Patent: Mar. 27, 2018

(54) INJECTION SYSTEM APPLIED TO A DIE CASTING MACHINE

(71) Applicant: CHUNG CHWAN ENTERPRISE CO., LTD., Taoyuan (TW)

(72) Inventor: Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 182 days.

(21) Appl. No.: 15/167,253

(22) Filed: May 27, 2016

(65) Prior Publication Data

US 2017/0239714 A1 Aug. 24, 2017

(30) Foreign Application Priority Data

Feb. 24, 2016 (TW) ..... 105105433 A

(51) Int. Cl.

| | |
|---|---|
| ***B22D 17/30*** | (2006.01) |
| ***B22D 17/04*** | (2006.01) |
| ***B22D 17/20*** | (2006.01) |
| ***B22D 17/00*** | (2006.01) |

(52) U.S. Cl.

CPC ..... *B22D 17/30* (2013.01); *B22D 17/005* (2013.01); *B22D 17/04* (2013.01); *B22D 17/2023* (2013.01)

(58) Field of Classification Search

CPC B22D 17/04; B22D 17/2015; B22D 17/2023; B22D 17/2272; B22D 17/30

USPC ..... 164/316–318

See application file for complete search history.

(56) References Cited

U.S. PATENT DOCUMENTS

| | | | | |
|---|---|---|---|---|
| 5,031,686 A * | 7/1991 | Kidd | ..... | B22D 17/04 164/120 |
| 5,657,812 A * | 8/1997 | Walter | ..... | B22D 17/04 164/113 |
| 2008/0142184 A1* | 6/2008 | Li | ..... | B22D 17/04 164/113 |

FOREIGN PATENT DOCUMENTS

| | | |
|---|---|---|
| CN | 102233418 A | 11/2011 |
| CN | 204953847 U | 1/2016 |
| TW | 274243 | 4/1996 |
| TW | 316506 | 9/1997 |
| TW | M481082 U | 7/2014 |

* cited by examiner

*Primary Examiner* — Kevin E Yoon

(74) *Attorney, Agent, or Firm* — Li&Cai Intellectual Property (USA) Office

(57) ABSTRACT

An injection system applied to a die casting machine includes a container module, a first mold module, a second mold module, and a pipe module. The container module includes a container casing member, and the container casing member has a material receiving space. The first mold module includes a first mold structure embedded inside the container casing member, a first inlet reinforcing structure disposed on the first mold structure and partially embedded inside the container casing member, and a second inlet reinforcing structure disposed on the first mold structure and partially embedded inside the container casing member. The second mold module includes a second mold structure. The pipe module includes a first pipe body connected between the first mold structure and the second mold structure and embedded inside the container casing member, and a second pipe body connected to the second mold structure.

10 Claims, 6 Drawing Sheets

INJECTION SYSTEM APPLIED TO A DIE CASTING MACHINE

BACKGROUND OF THE INVENTION

1. Field of the Invention

The instant disclosure relates to an injection system, and more particularly to an injection system applied to a die casting machine.

2. Description of Related Art

In a die casting machine, an injection plunger is used to inject a molten metal into a cavity of a die by an injection plunger. The quality of the cast product greatly depends upon the injection speed of the molten metal and the casting pressure (injection pressure). Therefore, it is necessary to suitable control the speed of movement (injection speed) and pressure of the injection cylinder driving the injection plunger. That is, the injection speed and the casting pressure (injection pressure) are controlled in accordance with the state of filling the molten metal between the casting cycles to realize the optimal injection operation.

For example, in a predetermined zone after the start of injection, the injection plunger is made to move by a low injection speed so that the molten metal in the injection sleeve does not enter air. Next, when the front end of the molten metal reaches the inlet of the cavity, the injection speed is switched from low speed to high speed to make the injection plunger move by a high injection speed so as to complete the filling of the molten metal into the cavity before the molten metal cools and solidifies. After the molten metal finishes being filled into the cavity, the casting pressure (injection pressure) is rapidly increased and the molten metal is allowed to solidify while applying pressure to the molten metal in the cavity.

SUMMARY OF THE INVENTION

One aspect of the instant disclosure relates to an injection system applied to a die casting machine.

One of the embodiments of the instant disclosure provides an injection system applied to a die casting machine, comprising: a container module, a first mold module, a second mold module, and a pipe module. The container module includes a container casing member, and the container casing member has a material receiving space. The first mold module includes a first mold structure embedded inside the container casing member, a first inlet reinforcing structure disposed on the first mold structure and partially embedded inside the container casing member, and a second inlet reinforcing structure disposed on the first mold structure and partially embedded inside the container casing member. The second mold module includes a second mold structure. The pipe module includes a first pipe body connected between the first mold structure and the second mold structure and embedded inside the container casing member, and a second pipe body connected to the second mold structure. The first mold structure has a first inner guide channel, a first left inlet communicated with the first inner guide channel, a first right inlet communicated with the first inner guide channel, and a first outlet communicated with the first inner guide channel, the first inlet reinforcing structure has a first communication opening communicated between the material receiving space and the first left inlet, and the second inlet reinforcing structure has a second communication opening communicated between the material receiving space and the first right inlet. The second mold structure has a second inner guide channel, a second inlet communicated with the second inner guide channel, and a second outlet opposite to the second inlet and communicated with the second inner guide channel. The first pipe body has a first connection portion embedded inside the first mold structure and communicated with the first outlet of the first mold structure, and a second connection portion embedded inside the second mold structure and communicated with the second inlet, and the second pipe body has a first connection portion embedded inside the second mold structure and communicated with the second outlet of the second mold structure, and a second connection portion exposed outside the second mold structure and connected to a nozzle.

More precisely, the container casing member has a first groove for receiving the first inlet reinforcing structure, and a second groove for receiving the second inlet reinforcing structure, and the first mold module further includes a first buffer structure disposed between the first inlet reinforcing structure and the first mold structure, and a second buffer structure disposed between the second reinforcing structure and the first mold structure.

More precisely, the injection system further comprises an enclosed structure including a first surrounding enclosed body, a second surrounding enclosed body, and a third surrounding enclosed boy. The first surrounding enclosed body is disposed on the first mold structure and surrounds the first pipe body for enclosing a first surrounding junction between the first mold structure and the first pipe body, the second surrounding enclosed body is disposed on the second mold structure and surrounds the first pipe body for enclosing a second surrounding junction between the second mold structure and the first pipe body, and the third surrounding enclosed body is disposed on the second mold structure and surrounds the second pipe body for enclosing a third surrounding junction between the second mold structure and the second pipe body.

More precisely, the first mold module further includes a plurality of support members disposed on a bottom side of the first mold structure and embedded inside the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure.

Another one of the embodiments of the instant disclosure provides an injection system applied to a die casting machine, comprising: a container module, a first mold module, a second mold module, a pipe module, and an enclosed structure. The container module includes a container casing member, and the container casing member has a material receiving space. The first mold module includes a first mold structure embedded inside the container casing member, a first inlet reinforcing structure disposed on the first mold structure and partially embedded inside the container casing member, and a second inlet reinforcing structure disposed on the first mold structure and partially embedded inside the container casing member. The second mold module includes a second mold structure. The pipe module includes a first pipe body connected between the first mold structure and the second mold structure and embedded inside the container casing member, and a second pipe body connected to the second mold structure. The enclosed structure includes a first surrounding enclosed body, a second surrounding enclosed body, and a third surrounding enclosed boy. The first surrounding enclosed body is disposed on the first mold structure and surrounds the first pipe body for enclosing a first surrounding junction between the first mold structure and the first pipe body. The second surrounding enclosed body is disposed on the second mold structure and surrounds the first pipe body for enclosing a second surrounding junction between the second mold structure and the first pipe body. The third surrounding enclosed body is disposed on the second mold structure and surrounds the second pipe body for enclosing a third surrounding junction between the second mold structure and the second pipe body.

More precisely, the container casing member has a first groove for receiving the first inlet reinforcing structure, and a second groove for receiving the second inlet reinforcing structure, and the first mold module further includes a first buffer structure disposed between the first inlet reinforcing structure and the first mold structure, and a second buffer structure disposed between the second reinforcing structure and the first mold structure. The first mold structure has a first inner guide channel, a first left inlet communicated with the first inner guide channel, a first right inlet communicated with the first inner guide channel, and a first outlet communicated with the first inner guide channel, the first inlet reinforcing structure has a first communication opening communicated between the material receiving space and the first left inlet, and the second inlet reinforcing structure has a second communication opening communicated between the material receiving space and the first right inlet. The second mold structure has a second inner guide channel, a second inlet communicated with the second inner guide channel, and a second outlet opposite to the second inlet and communicated with the second inner guide channel.

More precisely, the first mold module further includes a plurality of support members disposed on a bottom side of the first mold structure and embedded inside the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure. The first pipe body has a first connection portion embedded inside the first mold structure and communicated with the first outlet of the first mold structure, and a second connection portion embedded inside the second mold structure and communicated with the second inlet, and the second pipe body has a first connection portion embedded inside the second mold structure and communicated with the second outlet of the second mold structure, and a second connection portion exposed outside the second mold structure and connected to a nozzle.

Yet another one of the embodiments of the instant disclosure provides an injection system applied to a die casting machine, comprising: a container module, a first mold module, a second mold module, and a pipe module. The container module includes a container casing member. The container casing member has a material receiving space. The first mold module includes a first mold structure embedded inside the container casing member, a first inlet reinforcing structure disposed on the first mold structure and partially embedded inside the container casing member, and a second inlet reinforcing structure disposed on the first mold structure and partially embedded inside the container casing member. The second mold module includes a second mold structure. The pipe module includes a first pipe body connected between the first mold structure and the second mold structure and embedded inside the container casing member, and a second pipe body connected to the second mold structure.

Therefore, the corrosion resistance of the first mold structure of injection system of the instant disclosure is increased by matching the first inlet reinforcing structure and the second inlet reinforcing structure due to the designs of "the first inlet reinforcing structure disposed on the first mold structure and partially embedded inside the container casing member" and "the second inlet reinforcing structure disposed on the first mold structure and partially embedded inside the container casing member".

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DETAILED DESCRIPTION OF THE PREFERRED EMBODIMENTS

Figure 1:
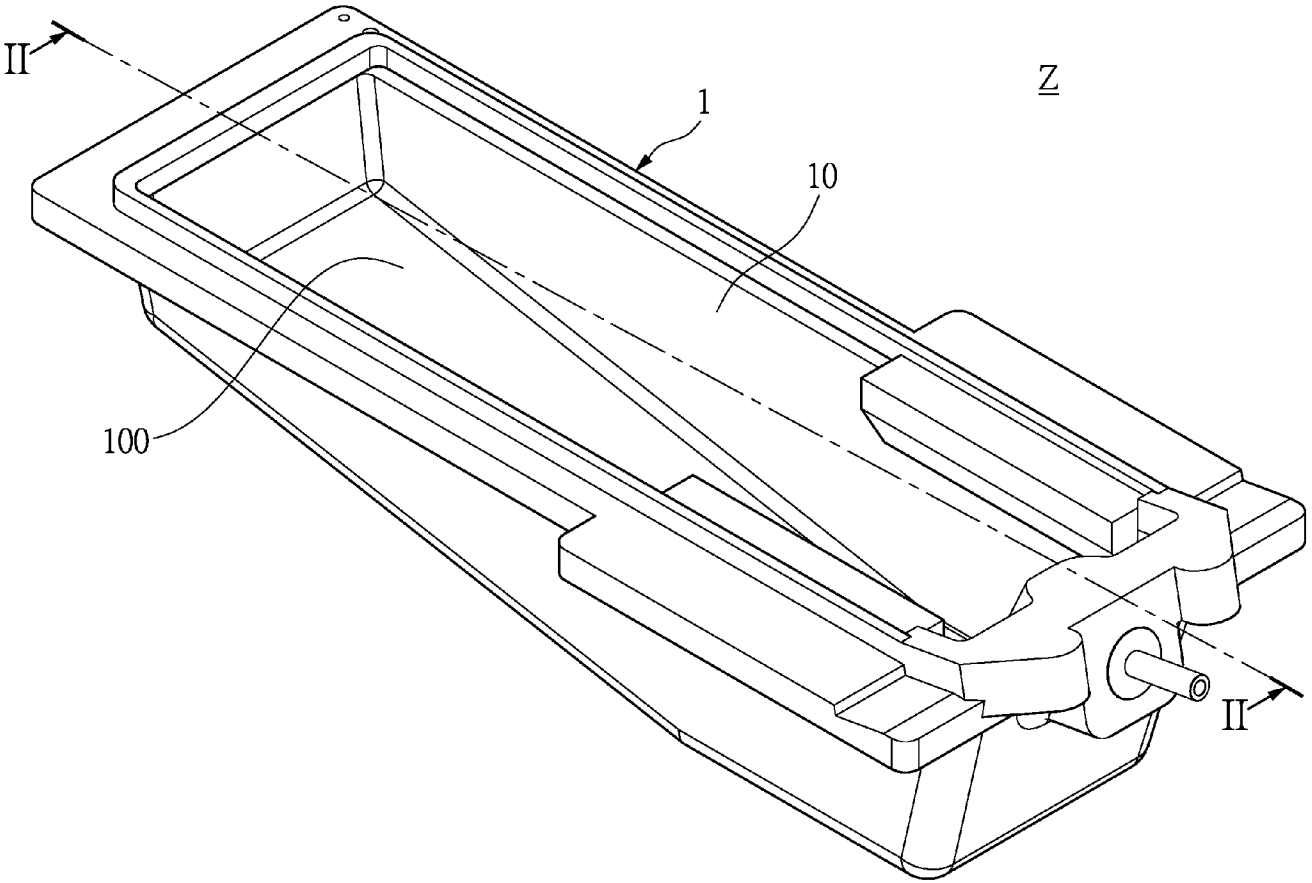
FIG. 1 shows a perspective, schematic view of an injection system applied to a die casting machine according to the instant disclosure.
Figure 2:
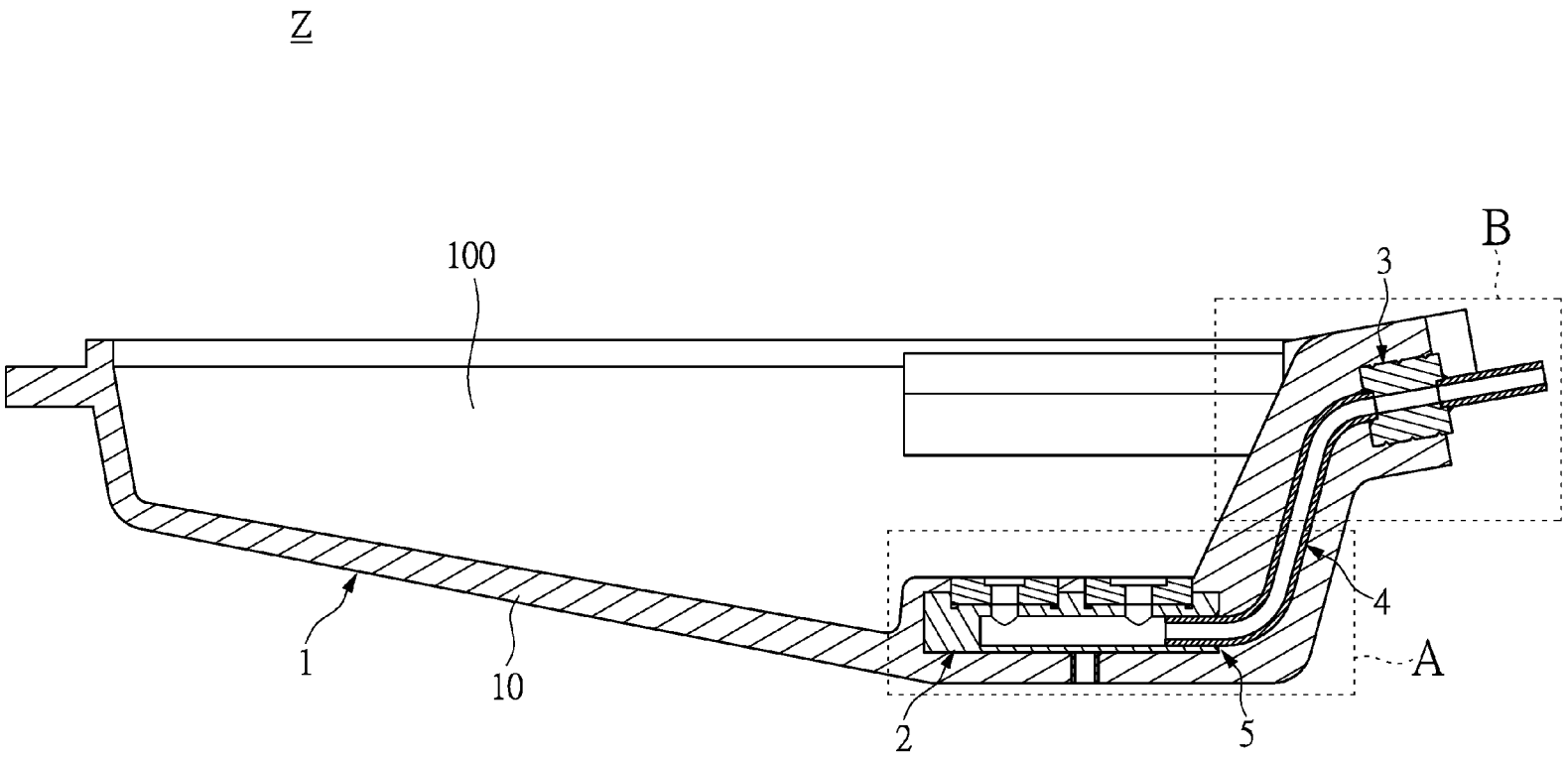
FIG. 2 shows a cross-sectional view taken along the section line II-II of FIG. 1.

The embodiments of "an injection system applied to a die casting machine" of the instant disclosure are described. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

Referring to FIG. 1 to FIG. 6, the instant disclosure provides an injection system Z applied to a die casting machine, comprising a container module 1, a first mold module 2, a second mold module 3, and a pipe module 4.

First, referring to FIG. 1 to FIG. 4, the container module 1 includes a container casing member 10, and the container casing member 10 has a material receiving space 100 for receiving metal materials. More precisely, the container casing member 10 has a first groove 1001 and a second groove 1002. For example, the container casing member 10 may be a zinc pot or any metal pot.

Moreover, referring to FIG. 3 to FIG. 6, the first mold module 2 includes a first mold structure 20 embedded inside the container casing member 10, a first inlet reinforcing structure 21 disposed on the first mold structure 20 and partially embedded inside the container casing member 10, and a second inlet reinforcing structure 22 disposed on the first mold structure 20 and partially embedded inside the container casing member 10. More precisely, the first inlet reinforcing structure 21 is received inside the first groove 1001 of the container casing member 10, and the second inlet reinforcing structure 22 is received inside the second groove 1002 of the container casing member 10. In addition, the first mold structure 20 has a first inner guide channel 200, a first left inlet 201 communicated with the first inner guide channel 200, a first right inlet 202 communicated with the first inner guide channel 200, and a first outlet 203 communicated with the first inner guide channel 200. The first inlet reinforcing structure 21 has a first communication opening 210 communicated between the material receiving space 100 and the first left inlet 201, and the second inlet reinforcing structure 22 has a second communication opening 220 communicated between the material receiving space 100 and the first right inlet 202.

In addition, referring to FIG. 3 to FIG. 6, the second mold module 3 includes a second mold structure 30. More precisely, the second mold structure 3 has a second inner guide channel 300, a second inlet 301 communicated with the second inner guide channel 300, and a second outlet 302 opposite to the second inlet 301 and communicated with the second inner guide channel 300.

Furthermore, referring to FIG. 3 to FIG. 6, the pipe module 4 includes a first pipe body 41 connected between the first mold structure 20 and the second mold structure 30 and embedded inside the container casing member 10, and a second pipe body 42 connected to the second mold structure 30. More precisely, the first pipe body 41 has a first connection portion 411 embedded inside the first mold structure 20 and communicated with the first outlet 203 of the first mold structure 20, and a second connection portion 412 embedded inside the second mold structure 30 and communicated with the second inlet 301. In addition, the second pipe body 42 has a first connection portion 421 embedded inside the second mold structure 30 and communicated with the second outlet 302 of the second mold structure 30, and a second connection portion 422 exposed outside the second mold structure 30 and connected to a nozzle N.

Figure 3:
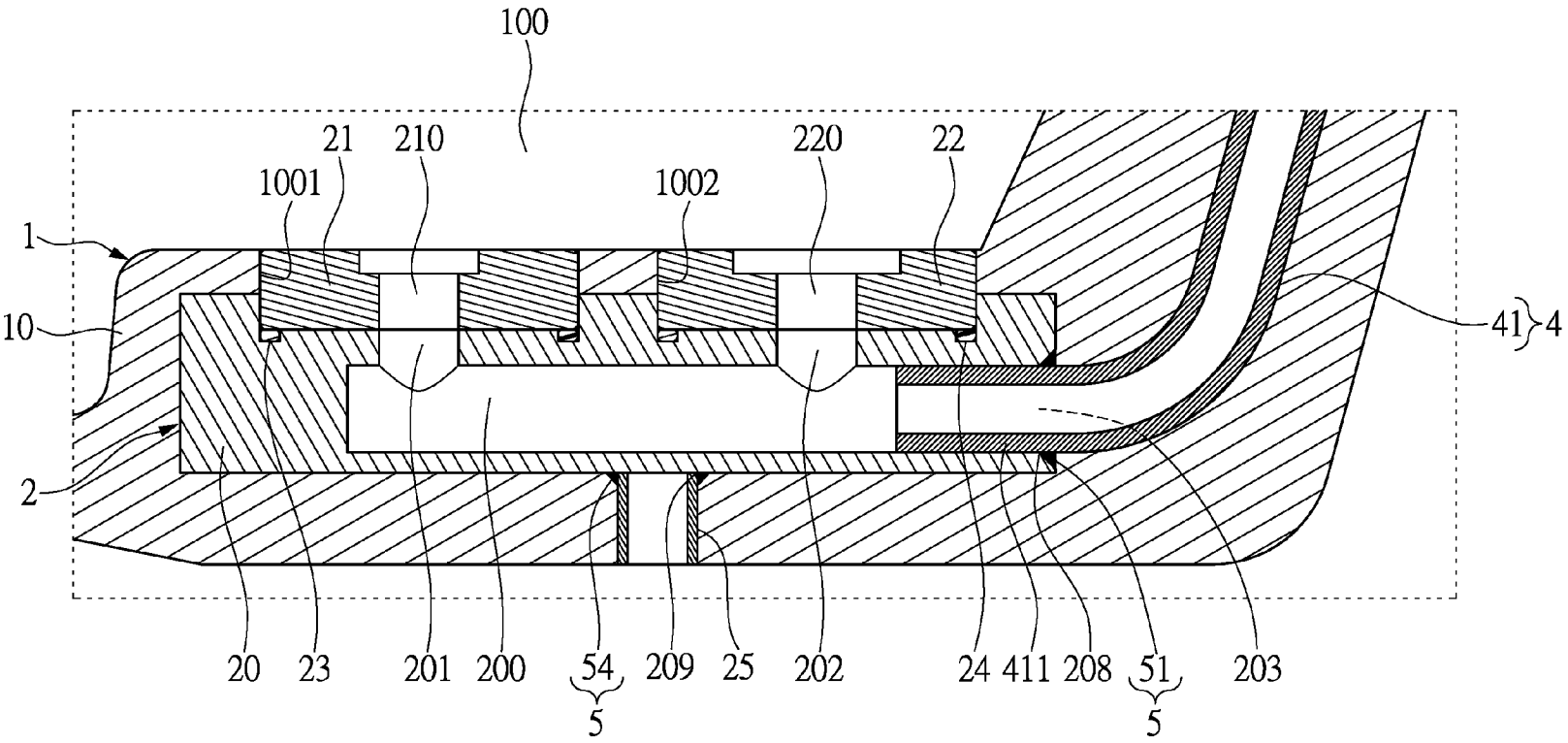
FIG. 3 shows an enlarged view taken on part A of FIG. 2.
Figure 4:
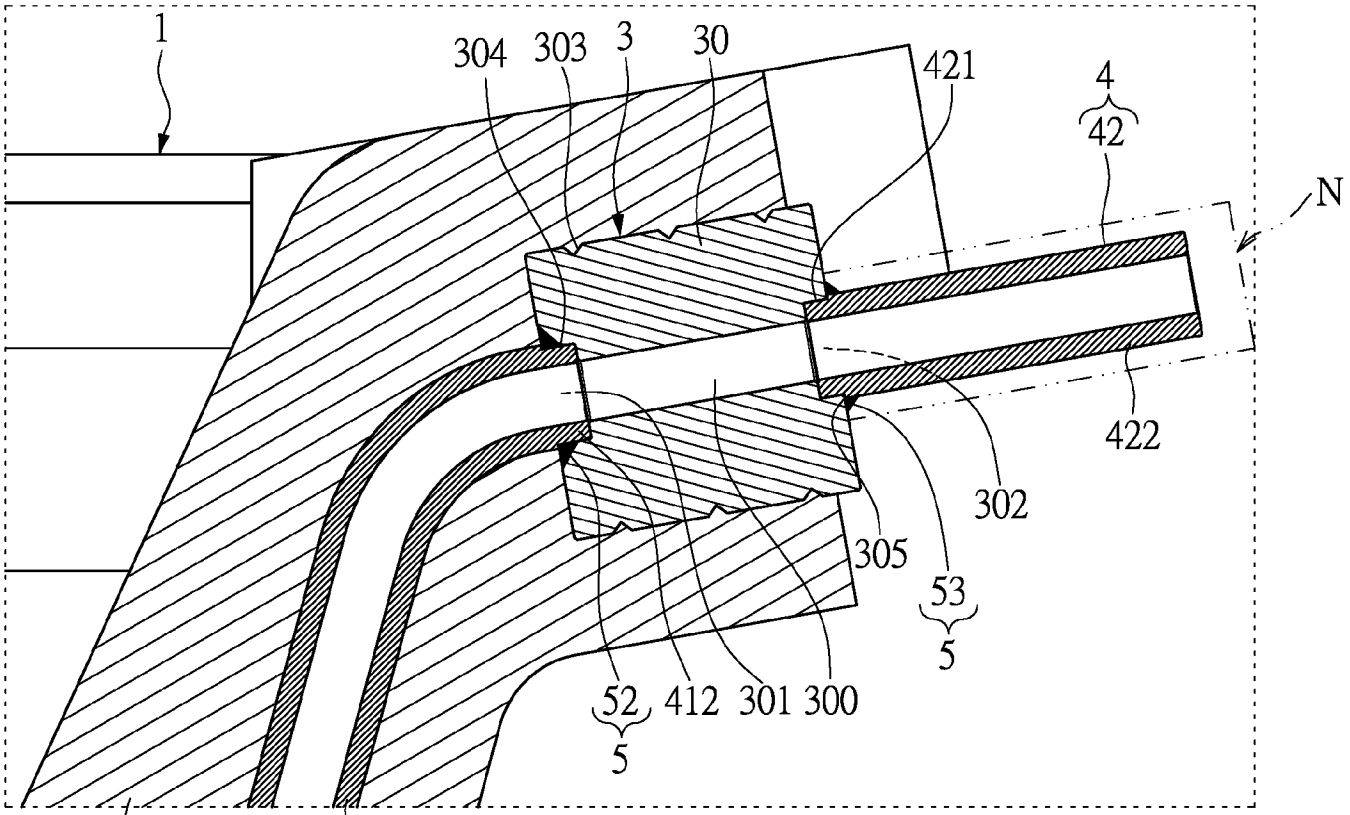
FIG. 4 shows an enlarged view taken on part B of FIG. 2.
Figure 5:
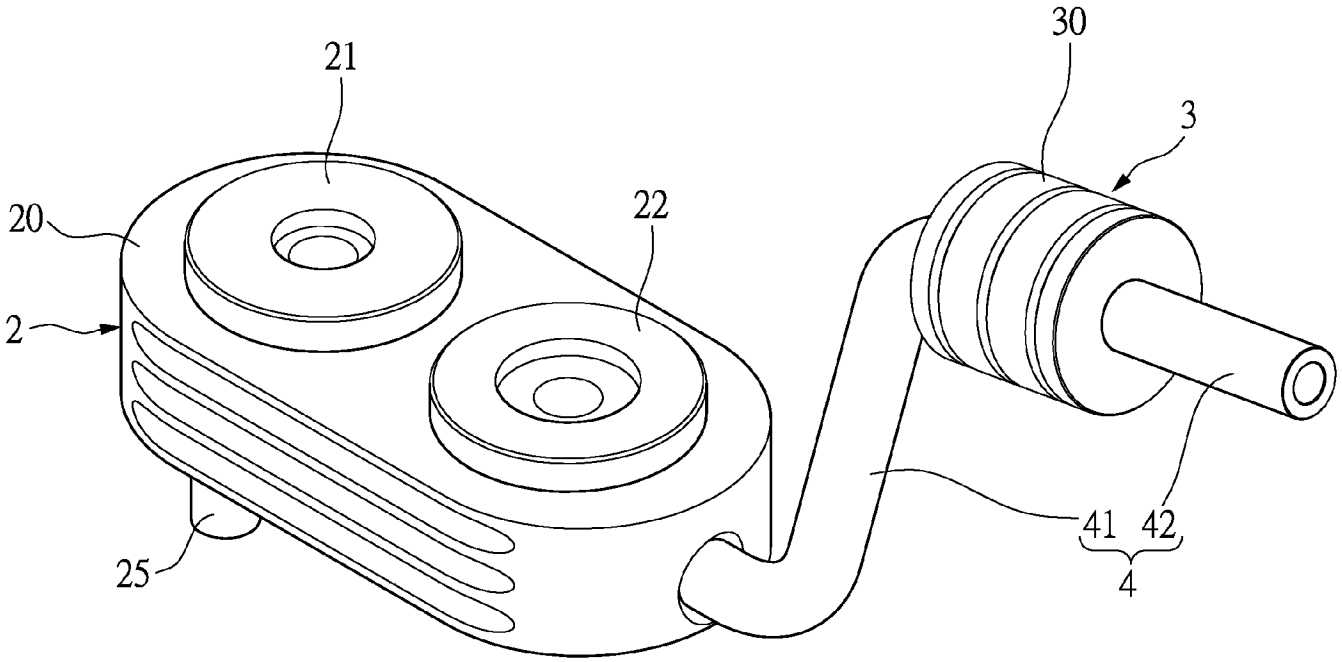
FIG. 5 shows a perspective, assembled, schematic view of a first mold structure, a second mold structure, and a pipe module of an injection system applied to a die casting machine according to the instant disclosure.
Figure 6:
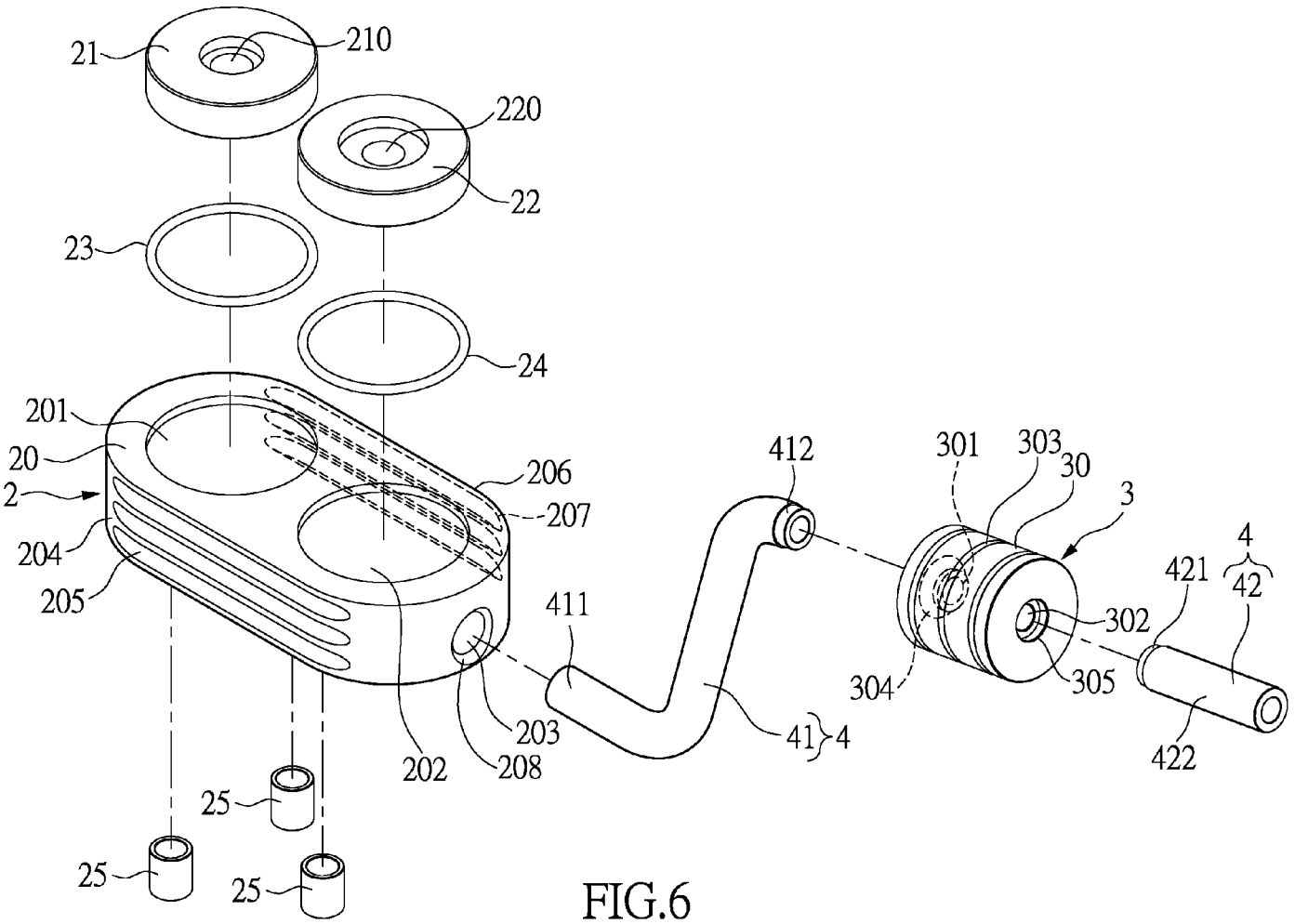
FIG. 6 shows a perspective, exploded, schematic view of a first mold structure, a second mold structure, and a pipe module of an injection system applied to a die casting machine according to the instant disclosure.

For one example, referring to FIG. 3, FIG. 4, and FIG. 6, the first mold module 2 further includes a first buffer structure 23 (or a first cushion structure) disposed between the first inlet reinforcing structure 21 and the first mold structure 20, and a second buffer structure 24 (or a second cushion structure) disposed between the second reinforcing structure 22 and the first mold structure 20. In addition, the first buffer structure 23 and the second buffer structure 24 are O-ring seals.

For another example, referring to FIG. 3, FIG. 4, and FIG. 6, the injection system Z applied to a die casting machine further comprises an enclosed structure 5. The enclosed structure 5 includes a first surrounding enclosed body 51, a second surrounding enclosed body 52, and a third surrounding enclosed boy 53. The first surrounding enclosed body 51 is disposed on the first mold structure 20 and surrounds the first pipe body 41 for enclosing a first surrounding junction 208 between the first mold structure 20 and the first pipe body 41. The second surrounding enclosed body 52 is disposed on the second mold structure 30 and surrounds the first pipe body 41 for enclosing a second surrounding junction 304 between the second mold structure 30 and the first pipe body 41. The third surrounding enclosed body 53 is disposed on the second mold structure 30 and surrounds the second pipe body 42 for enclosing a third surrounding junction 305 between the second mold structure 30 and the second pipe body 42. For example, the first surrounding enclosed body 51, the second surrounding enclosed body 52, and the third surrounding enclosed boy 53 are weld-all-around enclosed structures formed by full welding.

For yet another example, referring to FIG. 3, FIG. 4, and FIG. 6, the first mold module 2 further includes a plurality of support members 25 disposed on a bottom side of the first mold structure 20 and embedded inside the container casing structure 10. In addition, the first mold structure 20 has a plurality of first left positioning grooves 205 disposed on a left lateral wall 204 thereof for contacting the container casing structure 10, the first mold structure 20 has a plurality of first right positioning grooves 207 disposed on a right lateral wall 206 thereof for contacting the container casing structure 10, and the second mold structure 30 has a plurality of second positioning grooves 303 disposed on an outer perimeter surface thereof for contacting the container casing structure 10. Therefore, the first mold module 2 is firmly fixed inside the container casing structure 10 by using the support members 25 and matching the first left positioning grooves 205 and the first right positioning grooves 207.

Please note, referring to FIG. 3, the enclosed structure 5 further includes a plurality of fourth surrounding enclosed bodies 54, and each fourth surrounding enclosed body 54 is disposed on the bottom side of the first mold structure 20 and surrounds the corresponding support member 25 for enclosing a fourth surrounding junction 209 between the first mold structure 20 and the corresponding support member 25. For example, each fourth surrounding enclosed body 54 is a weld-all-around enclosed structure formed by full welding.

In conclusion, the corrosion resistance of the first mold structure of injection system Z of the instant disclosure is increased by matching the first inlet reinforcing structure 21 and the second inlet reinforcing structure 22 due to the designs of "the first inlet reinforcing structure 21 disposed on the first mold structure 20 and partially embedded inside the container casing member 10" and "the second inlet reinforcing structure 22 disposed on the first mold structure 20 and partially embedded inside the container casing member 10".

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. An injection system applied to a die casting machine, comprising:

a container module including a container casing member, wherein the container casing member has a material receiving space;

a first mold module including a first mold structure embedded inside the container casing member, a first inlet reinforcing structure disposed on the first mold structure and partially embedded inside the container casing member, and a second inlet reinforcing structure disposed on the first mold structure and partially embedded inside the container casing member;

a second mold module including a second mold structure; and a pipe module including a first pipe body connected between the first mold structure and the second mold structure and embedded inside the container casing member, and a second pipe body connected to the second mold structure;

wherein the first mold structure has a first inner guide channel, a first left inlet communicated with the first inner guide channel, a first right inlet communicated with the first inner guide channel, and a first outlet communicated with the first inner guide channel, the first inlet reinforcing structure has a first communication opening communicated between the material receiving space and the first left inlet, and the second inlet reinforcing structure has a second communication opening communicated between the material receiving space and the first right inlet;

wherein the second mold structure has a second inner guide channel, a second inlet communicated with the second inner guide channel, and a second outlet opposite to the second inlet and communicated with the second inner guide channel;

wherein the first pipe body has a first connection portion embedded inside the first mold structure and communicated with the first outlet of the first mold structure, and a second connection portion embedded inside the second mold structure and communicated with the second inlet, and the second pipe body has a first connection portion embedded inside the second mold structure and communicated with the second outlet of the second mold structure, and a second connection portion exposed outside the second mold structure and connected to a nozzle.

2. The injection system of claim 1, wherein the container casing member has a first groove for receiving the first inlet reinforcing structure, and a second groove for receiving the second inlet reinforcing structure, and the first mold module further includes a first buffer structure disposed between the first inlet reinforcing structure and the first mold structure, and a second buffer structure disposed between the second reinforcing structure and the first mold structure.

3. The injection system of claim 1, further comprising an enclosed structure including a first surrounding enclosed body, a second surrounding enclosed body, and a third surrounding enclosed boy, wherein the first surrounding enclosed body is disposed on the first mold structure and surrounds the first pipe body for enclosing a first surrounding junction between the first mold structure and the first pipe body, the second surrounding enclosed body is disposed on the second mold structure and surrounds the first pipe body for enclosing a second surrounding junction between the second mold structure and the first pipe body, and the third surrounding enclosed body is disposed on the second mold structure and surrounds the second pipe body for enclosing a third surrounding junction between the second mold structure and the second pipe body.

4. The injection system of claim 1, wherein the first mold module further includes a plurality of support members disposed on a bottom side of the first mold structure and embedded inside the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure.

5. An injection system applied to a die casting machine, comprising:

a container module including a container casing member, wherein the container casing member has a material receiving space;

a first mold module including a first mold structure embedded inside the container casing member, a first inlet reinforcing structure disposed on the first mold structure and partially embedded inside the container casing member, and a second inlet reinforcing structure disposed on the first mold structure and partially embedded inside the container casing member;

a second mold module including a second mold structure;

a pipe module including a first pipe body connected between the first mold structure and the second mold structure and embedded inside the container casing member, and a second pipe body connected to the second mold structure; and an enclosed structure including a first surrounding enclosed body, a second surrounding enclosed body, and a third surrounding enclosed boy;

wherein the first surrounding enclosed body is disposed on the first mold structure and surrounds the first pipe body for enclosing a first surrounding junction between the first mold structure and the first pipe body;

wherein the second surrounding enclosed body is disposed on the second mold structure and surrounds the first pipe body for enclosing a second surrounding junction between the second mold structure and the first pipe body;

wherein the third surrounding enclosed body is disposed on the second mold structure and surrounds the second pipe body for enclosing a third surrounding junction between the second mold structure and the second pipe body.

6. The injection system of claim 5, wherein the container casing member has a first groove for receiving the first inlet reinforcing structure, and a second groove for receiving the second inlet reinforcing structure, and the first mold module further includes a first buffer structure disposed between the first inlet reinforcing structure and the first mold structure, and a second buffer structure disposed between the second reinforcing structure and the first mold structure, wherein the first mold structure has a first inner guide channel, a first left inlet communicated with the first inner guide channel, a first right inlet communicated with the first inner guide channel, and a first outlet communicated with the first inner guide channel, the first inlet reinforcing structure has a first communication opening communicated between the material receiving space and the first left inlet, and the second inlet reinforcing structure has a second communication opening communicated between the material receiving space and the first right inlet, wherein the second mold structure has a second inner guide channel, a second inlet communicated with the second inner guide channel, and a second outlet opposite to the second inlet and communicated with the second inner guide channel.

7. The injection system of claim 6, wherein the first mold module further includes a plurality of support members disposed on a bottom side of the first mold structure and embedded inside the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure, wherein the first pipe body has a first connection portion embedded inside the first mold structure and communicated with the first outlet of the first mold structure, and a second connection portion embedded inside the second mold structure and communicated with the second inlet, and the second pipe body has a first connection portion embedded inside the second mold structure and communicated with the second outlet of the second mold structure, and a second connection portion exposed outside the second mold structure and connected to a nozzle.

8. An injection system applied to a die casting machine, comprising:

a container module including a container casing member, wherein the container casing member has a material receiving space;

a first mold module including a first mold structure embedded inside the container casing member, a first inlet reinforcing structure disposed on the first mold structure and partially embedded inside the container casing member, and a second inlet reinforcing structure disposed on the first mold structure and partially embedded inside the container casing member;

a second mold module including a second mold structure; and a pipe module including a first pipe body connected between the first mold structure and the second mold structure and embedded inside the container casing member, and a second pipe body connected to the second mold structure.

9. The injection system of claim 8, wherein the container casing member has a first groove for receiving the first inlet reinforcing structure, and a second groove for receiving the second inlet reinforcing structure, and the first mold module further includes a first buffer structure disposed between the first inlet reinforcing structure and the first mold structure, and a second buffer structure disposed between the second reinforcing structure and the first mold structure, wherein the first mold structure has a first inner guide channel, a first left inlet communicated with the first inner guide channel, a first right inlet communicated with the first inner guide channel, and a first outlet communicated with the first inner guide channel, the first inlet reinforcing structure has a first communication opening communicated between the material receiving space and the first left inlet, and the second inlet reinforcing structure has a second communication opening communicated between the material receiving space and the first right inlet, wherein the second mold structure has a second inner guide channel, a second inlet communicated with the second inner guide channel, and a second outlet opposite to the second inlet and communicated with the second inner guide channel.

10. The injection system of claim 9, wherein the first mold module further includes a plurality of support members disposed on a bottom side of the first mold structure and embedded inside the container casing structure, the first mold structure has a plurality of first left positioning grooves disposed on a left lateral wall thereof for contacting the container casing structure, the first mold structure has a plurality of first right positioning grooves disposed on a right lateral wall thereof for contacting the container casing structure, and the second mold structure has a plurality of second positioning grooves disposed on an outer perimeter surface thereof for contacting the container casing structure, wherein the first pipe body has a first connection portion embedded inside the first mold structure and communicated with the first outlet of the first mold structure, and a second connection portion embedded inside the second mold structure and communicated with the second inlet, and the second pipe body has a first connection portion embedded inside the second mold structure and communicated with the second outlet of the second mold structure, and a second connection portion exposed outside the second mold structure and connected to a nozzle.

* * * * *